United States Patent [19]

Zenkner

[11] 3,984,196

[45] Oct. 5, 1976

[54] METHOD AND BURNER FOR COMBUSTION OF WASTE AIR

[76] Inventor: Kurt Zenkner, Hertzstr. 10, Ettlingen, Germany

[22] Filed: May 28, 1974

[21] Appl. No.: 473,558

[52] U.S. Cl. ..... 431/5; 431/174; 431/202

[51] Int. Cl.[2] ..... F23D 13/20

[58] Field of Search ..... 431/5, 8, 9, 202, 174; 23/277 C

[56] References Cited

UNITED STATES PATENTS

| | | | |
|---|---|---|---|
| 2,952,310 | 9/1960 | Te Nuyl et al. | 431/5 |
| 3,433,218 | 3/1969 | Von Wiesenthal | 431/5 X |
| 3,549,333 | 12/1970 | Tabak | 431/5 X |
| 3,806,322 | 4/1974 | Tabak | 23/277 C |

*Primary Examiner*—Edward G. Favors

[57] ABSTRACT

A method of operating a burner system for the thermal post-combustion of waste air from industrial plants, in which the burning system includes a combustion chamber and a burner system opening into the combustion chamber is provided with supply pipes for the waste air through which it is conducted into the zone of the burner mouth inside the combustion chamber. A primary flame is produced which explodes into a fan at a point where the pipes open into the combustion chamber. The waste air is introduced into the combustion chamber approximately concentrically with and around the primary flame and the jet of waste air is divided into a large number of individual jet rays. The incoming waste air is given a twisting motion around the longitudinal median axis of the burner tube, and the primary flame is twisted in a direction opposite the direction of twisting of at least that part of the annular jet which is adjacent the primary flame.

50 Claims, 33 Drawing Figures

METHOD AND BURNER FOR COMBUSTION OF WASTE AIR

BACKGROUND OF THE INVENTION

1. Field of the Invention The invention is concerned with a method by which to operate a burner system in a plant for the thermal post-combustion of waste air from industrial plants, which consists of a combustion chamber, a burner proper which opens into the combustion chamber, and feed-pipes for the waste air to be burnt up in the post-combustion process, which admit the air into the combustion chamber in the zone where the burner joins the latter. The invention moreover relates to a burner system which is operable by the method in question.

SUMMARY OF THE INVENTION

It is an aim of the invention to provide for means which enable the post-combustion of waste air to be as complete as possible while using the smallest possible quantity of auxiliary energy. In particular, the invention is concerned with the possibility of combining an optimum manner of operation with the most suitable design by which to answer the above requirements.

For this purpose the new method provides for a primary flame in the zone where the burner joins the combustion chamber, which explodes into a fan with a large surface area, and it introduces the waste air into the combustion chamber in the form of an air stream which encircles the primary flame concentrically while it is broken up into a large number of individual jets, possibly of varying direction and being turbulent. For better results, the primary flame entering the combustion chamber is twisted around the longitudinal median axis of the tube which introduces the auxiliary energy. The waste air could be admitted into the combustion chamber, for example, in the form of at least one annular jet, to encircle the burner tube co-axially, and twisted, as it enters the combustion chamber, around the longitudinal median axis of the burner tube, the direction of twisting preferably being opposite to the twist of the primary flame. Alternatively provision could be made for two annular jets of waste air which are co-axial with each other and with the primary flame, and which are twisted around the longitudinal median axis of the burner tube as the jets enter the combustion chamber, the inner annular jet preferably being twisted in a direction opposed to the twist of the flame, and the outer annular jet being twisted in the same direction as the flame. Finally provision could for example be made for an annular jet of waste air to be introduced into the combustion chamber wherein the air jet passing coaxially along the burner tube is broken up into the multiple of free individual jets of a small diameter with a large surface and considerable speed.

In the case of the method according to the invention, provision is made for the auxiliary energy which is introduced into the system, to be burnt up in a primary flame, and to admit the burning, or burnt, very hot gases into the waste air stream (to be cleaned), so that initial ignition takes place of the combustible matter in the mass of turbulent waste air. This ignition cannot take place unless the hot waste gas of the primary flame can reach every combustible particle in the waste air; this is why it has been proposed to let the waste air stream fan out into a large number of individual air jets, the latter presenting a multitude of free, small-diameter, air jets having a large surface area and a high speed and, moreover, a great suction power so that they can draw in the hot waste gases of the primary flame, thus themselves contributing towards the ignition of the impurities and foreign matter they contain. The auxiliary energy is introduced, according to the invention, into the centre of an annular burner to be mixed with a small proportion of the waste air and subjected to a process of pre-combustion — it being assumed of course that the oxygen content in the waste air is high enough to burn the auxiliary energy up. The main body of the waste air stream is broken up into free jets of air, and concentrically around the primary flame, and blown into the combustion chamber, the free jets of air attracting thereby from the flame matter at a high temperature and high radial concentration. This means that impurities, foreign matter or the like, which are contained in the stream of turbulent air and carried along by the waste air stream, can ignite. The actual combustion of impurities can therefore take place at a temperature in the combustion chamber which is low compared with the ignition temperature. By direction the free air jets of the waste air stream away from the axis of the combustion chamber, the flame is forced to explode, whereby it assumes the shape of a globular, star-shaped, or fan-shaped object, opening a free space in the centre through which the gases in the combustion chamber can return to the flame. This circulation enables the waste air particles to come repeatedly into contact with the flame, and ignite. The waste air stream can be divided into numerous individual free air jets by various means, some of them being described further below, but the effect can also be produced by the superposition of two thin, superimposed, and oppositely, rotating, concentric twist-jets. The reciprocal interference of the two twisted jets is so great in the zones where the air is mixed that the jet surfaces are broken up into turbulent strings having a high suction effect.

A burner system designed for operation according to the new method will be characterized by an annular tube (a ring-shaped reservoir) surrounding the burner-tube through which the fuel feed pipe passes, into which the waste air is introduced through a waste air spiral, and by outlets for the waste air from the reservoir towards the combustion chamber which are associated with at least one twisting apparatus between the outlets and the combustion chamber, by the aid of which the waste air stream is twisted around the longitudinal median axis of the burner tube. It is an advantage when two concentric annular tubes are provided for the waste air, each comprising its own twisting apparatus, one twisting in the opposite direction from the other, wherein the tube portion which incorporates the twisting apparatus is preferably tapering outwardly towards the outside, in the form of a funnel. An alternative burner arrangement for operation in conformity with the new method could comprise an annular tube around the burner tube accommodating the fuel supply pipe, to receive the waste air through a feeder spiral, wherein the inner portion of the annular tube is connected with the combustion chamber through a large number of individual, small-diameter, tubes which extend from the end-wall of the annular tube-reservoir into the combustion chamber where they are preferably inclined at a suitable angle, pointing outwards.

The active area of the flame produced with the arrangement according to the invention is as large as possible, and there is, moreover, the possibility of recirculation inside the combustion chamber. The flame, burning from a flame-centre, explodes spherically, leaving the central area free for the air to return to the flame. The twisting apparatus, working in conjunction with the effect of the numerous individual tubes, causes the air to be dispersed into a multitude of fine turbulent air jets which form a turbulent area of jets having an extremely intense mixing power and attracting medium from the surrounding zones and thus notably contributing towards the intense stream of air which returns to the flame through the middle zone. The hot gases in this central zone are thereby carried into the turbulent zone where the desired ignition takes place as explained above.

BRIEF DESCRIPTION OF THE DRAWINGS

The drawing shows, by way of example, a number of embodiments of the invention. In particular, are shown in FIG. 1 a burner system according to the invention in a general view, presented schematically in order to explain the principle of the operation, FIGS. 2, 3 two theoretically feasible embodiments of the zone where the burner tube joins the combustion chamber, in schematic elevation, FIG. 4 a first practical layout of the portion of the burner system in the zone where the burner tube joins the combustion chamber, showing a detail in elevation and in part-section, FIG. 5 the arrangement according to FIG. 4 in a view in conformity with Arrow IV, FIG. 6 an alternative arrangement (variant) of the layout according to FIG. 4, using the same principle of presentation, but showing a burner system which is gas-operated instead of using oil as does a fuel as the system shown in FIG. 4.

DESCRIPTION OF THE PREFERRED EMBODIMENTS

Figure 1:
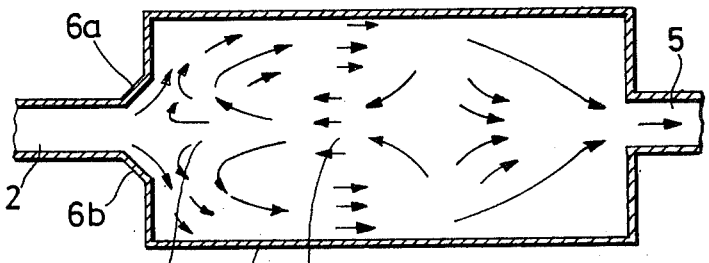
Figure 2:
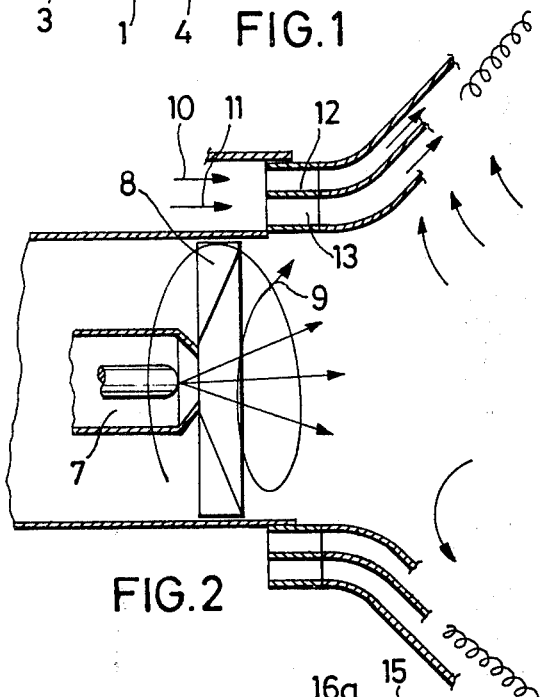
Figure 3:
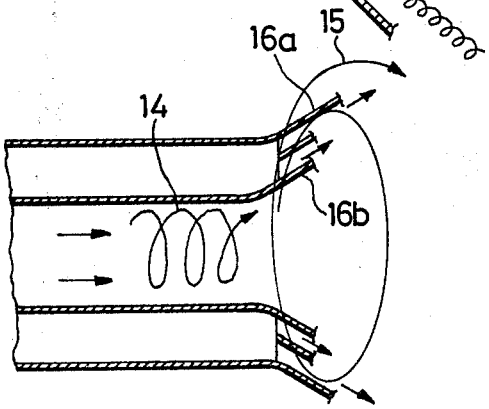

FIGS. 1, 2, and 3 explain the method according to the invention. In the combustion chamber 1, into which the burner 2 opens, a so-called root-shaped flame 3 is generated which burns from a centre and explodes fan-like under the effect of means which are described further below. As a result, the streaming direction is reversed as indicated roughly by the arrows 4. In any case, the flame-surface area is great. The purpose of forcing the flame to explode is to create conditions where air can flow back through the middle zone while the main (air) stream is directed by the flame towards the outside. The waste gases are discharged through 5. The flame is caused to explode spherically or fan-like by the form of the combustion chamber which suddenly widens at the point where the burner joins the combustion chamber. The spontaneous spreading of the flame can moreover be assisted by teh shape of guide-walls *6a, 6b;* on the other hand, the flame can be caused to explode under the effect of a twisting apparatus, the principle of which is depicted in FIG. 2, where, viewed in the direction of flow, a twisting apparatus or mechanism 8 is used at a position beyond the burner mouth 7. This consists, for example, of suitably designed blades or the like, the twisting device twisting the primary flame in the direction of arrow 9. The waste-air stream around the primary flame, arriving roughly at 10, is thereby broken up into a large number of individual jets of air which can move in varying directions and in a turbulent fashion.

Figure 4:
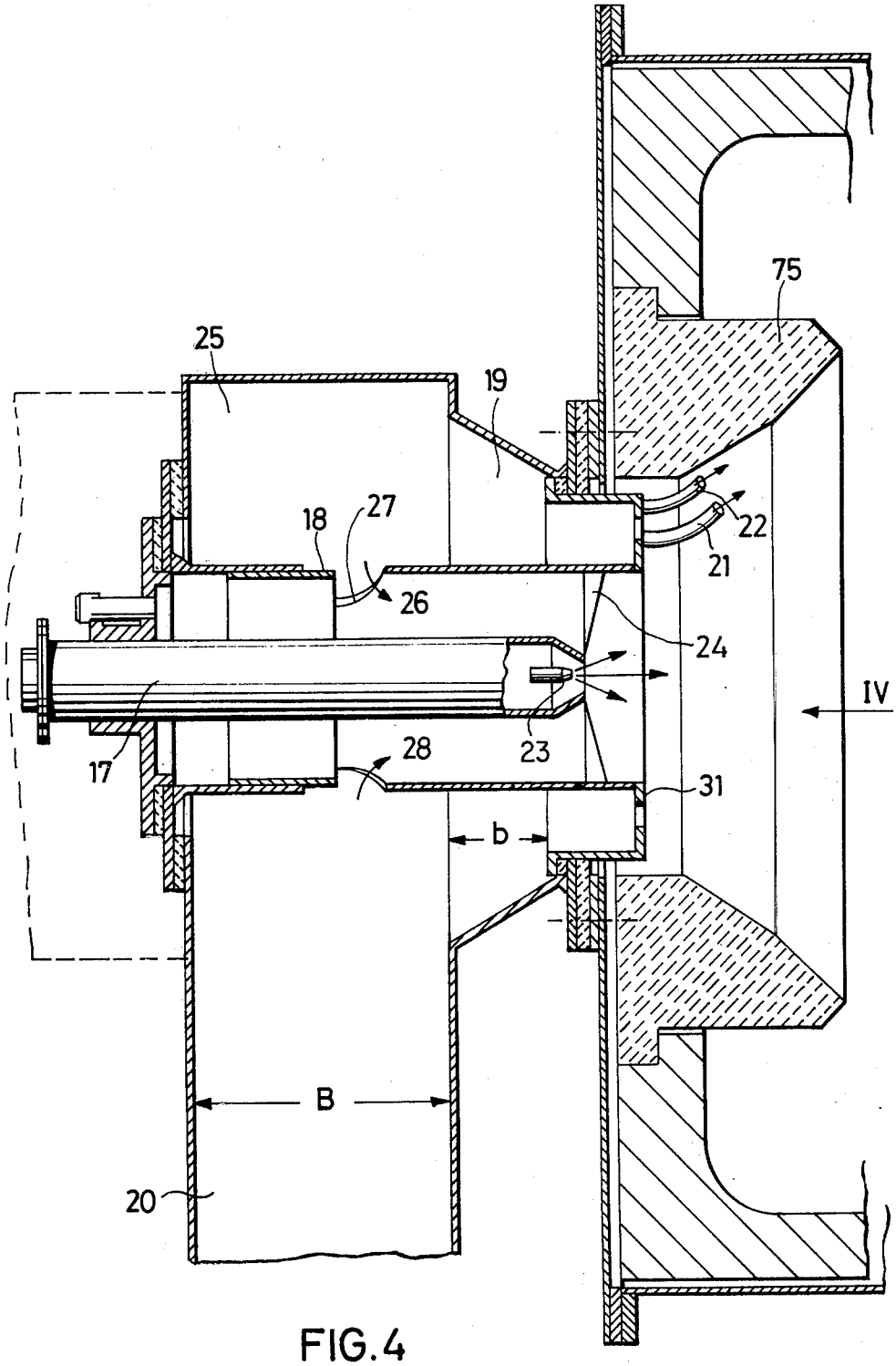

According to FIGS. 2 and 3 the waste air is conveyed in the form of at least one annular jet which passes along the burner tube in co-axial arrangement, two annular jets 10, 11 of this type being preferably used which are twisted around the longitudinal median axis of the burner type 7 by the twisting devices 12, 13. With two annular jets 10, 11, they are twisted in the opposite directions, the jet on the inside of the system, 11, being twisted in a direction opposite to the twist of the primary flame as shown in arrow 9, while the outer annular jet 10 is again twisted oppositely to the twist of the inner annular jet 11. The fact that the two jets are twisted in reversed directions makes them interfere with each other to such an extent that a turbulent wall is created which causes the jets to disintegrate into individual strings; again mixing is intense which ensures that an injector effect is exerted on the primary flame and that the medium is sucked out of the primary flame. This causes, on the one hand, the jet to blast asunder and gives rise to an intense recirculation through the middle, while on the other hand it enables hot gases to leave the primary flame and be carried into the turbulent zones which means that waste-air particles have a repeated chance of ignition in the zones of turbulence. The large surface areas which are created in consequence of these reactions make an extremely intense exchange of air possible; large quantities of the medium come into contact with the hot waste gases, which means that combustion is extremely intensified. FIG. 3 shows a very similar effect. Here, the movements of the waste air stream according to arrow 15 are caused by the twisting of the central primary flame in accordance with arrow 14. The figure shows, moreover, very clearly that the inclined direction of wall portions 16*a* and 16*b* promotes the outward tendency of the exploding flame. Obviously the waste air can be introduced into the system in accordance with a further variant of the invention, wherein the air is admitted in the form of an annular jet which co-axially encircles the burner-tube, this jet being dissolved into a multitude of free individual small-diameter jets when it enters the combustion chamber, so that it is dispersed into jets having a large total surface and moving at a fast speed. FIG. 4 depicts a practical example for this variant according to the invention.

Figure 5:
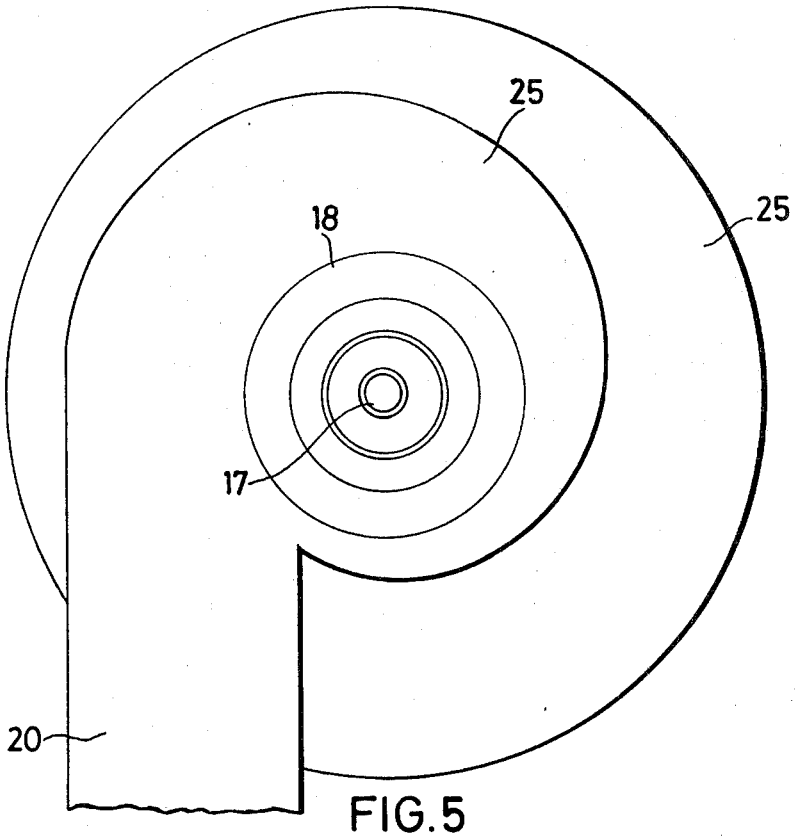

While the arrangements according to FIGS. 1 to 3 comprise a burner tube which is concentrically surrounded by one or possibly by two concentric annular tubes into which the waste air is introduced, for example through a waste air spiral and which incorporates waste-air outlets towards the combustion chamber with at least one so-called twisting device or rather two twisting devices 12, 13 which are located in a zone behind the outlets when viewed in the direction of flow and serve to twist the waste-air streams around the longitudinal median axis of the burner tube, the arrangement according to FIGS. 4 and 5 comprises a burner tube 18 which accommodates the oil supply pipe 17 and is surrounded by a reservoir 19 (an annular tube) into which the waste air is introduced over a waste air spiral 20, the inner part of the reservoir being connected with the combustion chamber through a large number of individual, small-diameter, tubes 21, 22 which extend from the front wall of the annular tube into the combustion chamber where they are preferably directed towards the outside at a suitable angle, as clearly indicated in FIG. 4. As before, the mouth of the supply pipe 17 is associated with a twisting-device 24 as indicated at 23, twisting the primary flame around the longitudinal median axis of the burner tube, wherein the annular tube (reservoir) 19 extends beyond the twisting device 24 behind the jet mouth by an amount which corresponds approximately to two or three times the diameter of the burner tube. The annular tube (reservoir) 19 lies axially downstream from the inlet head 25 of the waste-air spiral 20 when viewed in the flow direction, and it is connected with the spiral, the width "*b*" of the annular tube being to the width "B" of the inlet head of the waste air spiral, as 1 : 2. The annular space between the fuel supply pipe 17 and the burner tube 18, that is to say the annular space 26, is connected with the interior of the annular tube 19 or the inlet head 25 respectively, by means of apertures 27 through which primary air (for combustion of fuel) is admitted into the annular space, as indicated by arrows 28. The flow cross-section of these holes 27 is adjustable, the burner tube being equipped, for example, with a cylindrical slide which is displaceable in the axial direction and can be moved along the tube to close the openings partly or completely as desired. According to FIG. 4, these openings can be distributed over the entire axial length of the burner tube. This is also the case in the arrangement according to FIG. 6 where the passage through the openings 29 can be regulated by means of the slide 30. As indicated by arrows 28, the waste air will flow towards the front in space 26, where a twisting device, which is adjustable in the axial direction, causes the air to revolve, the oil being injected into this rotating air stream. The spacing between the nozzle of the jet and the end-wall 31 of the reservoir serves for the improvement of the pre-combustion, in fact, it constitutes a combustion chamber in its own right. The flame can be controlled from the rear, but it can also be controlled from the front, the monitoring device being built in at the front and giving a view of the flame through the inner tube. The passage holes can, if desired, be located at an individual position in relation to the axial tube length, for example in the middle portion in which case the apertures are conveniently distributed around the entire circumference of the tube.

Figure 6:
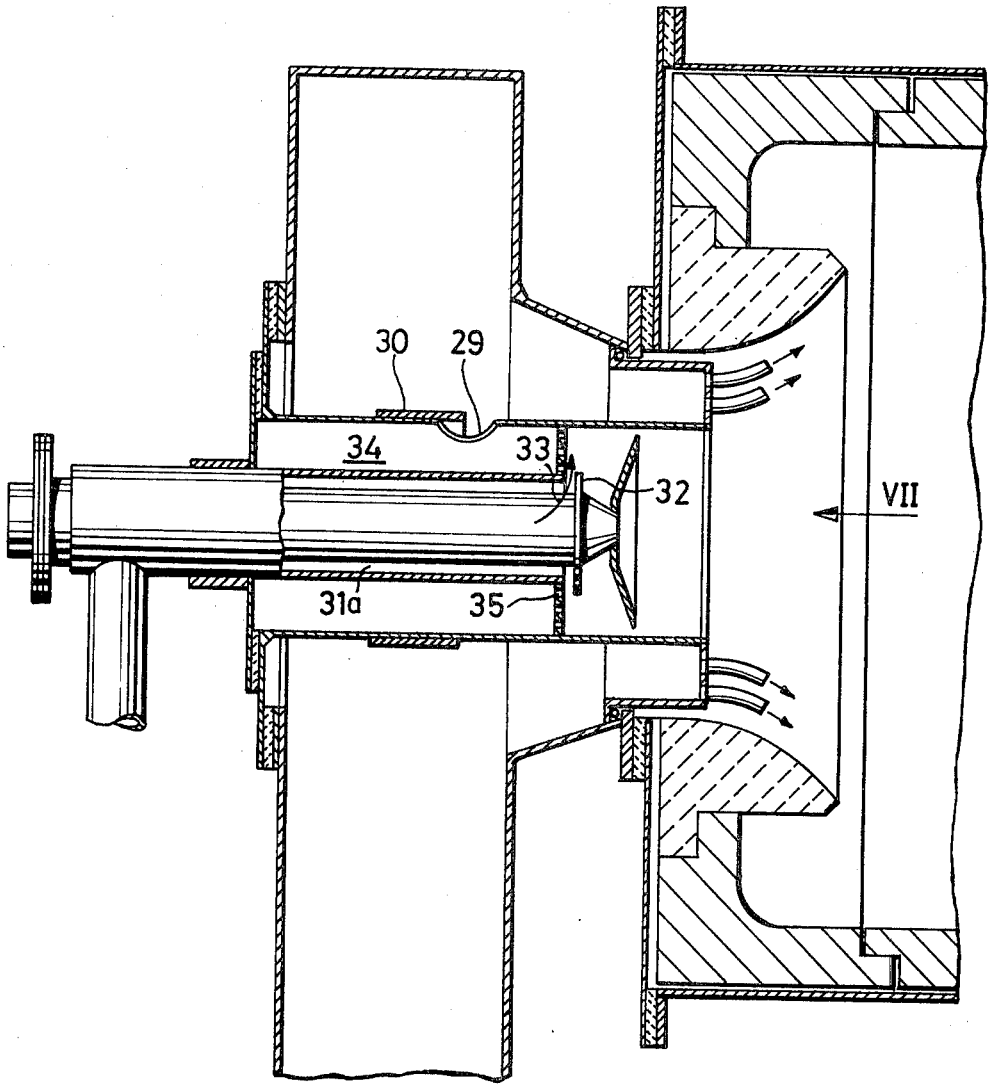
Figure 7:
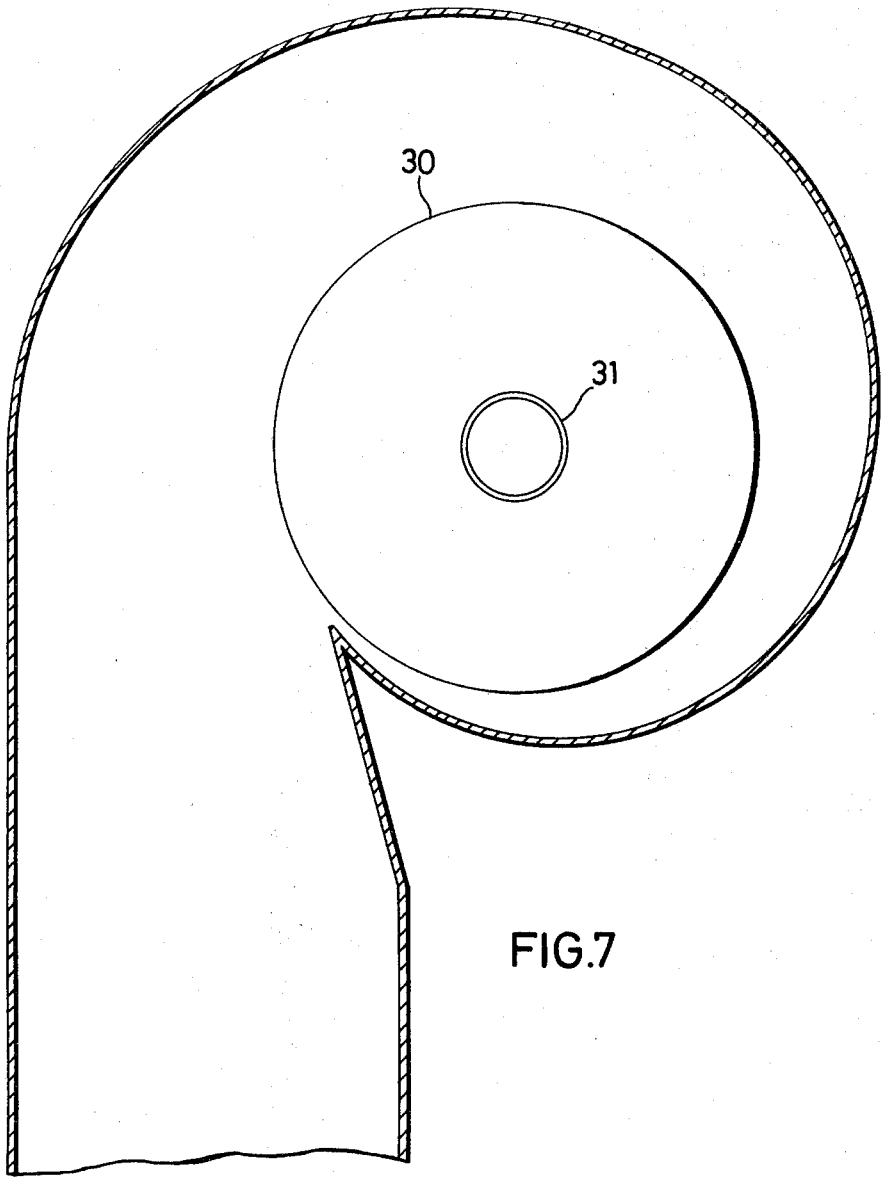
FIG. 7 the arrangement according to FIG. 6 in a view according to Arrow VII in FIG. 6.
Figure 20:
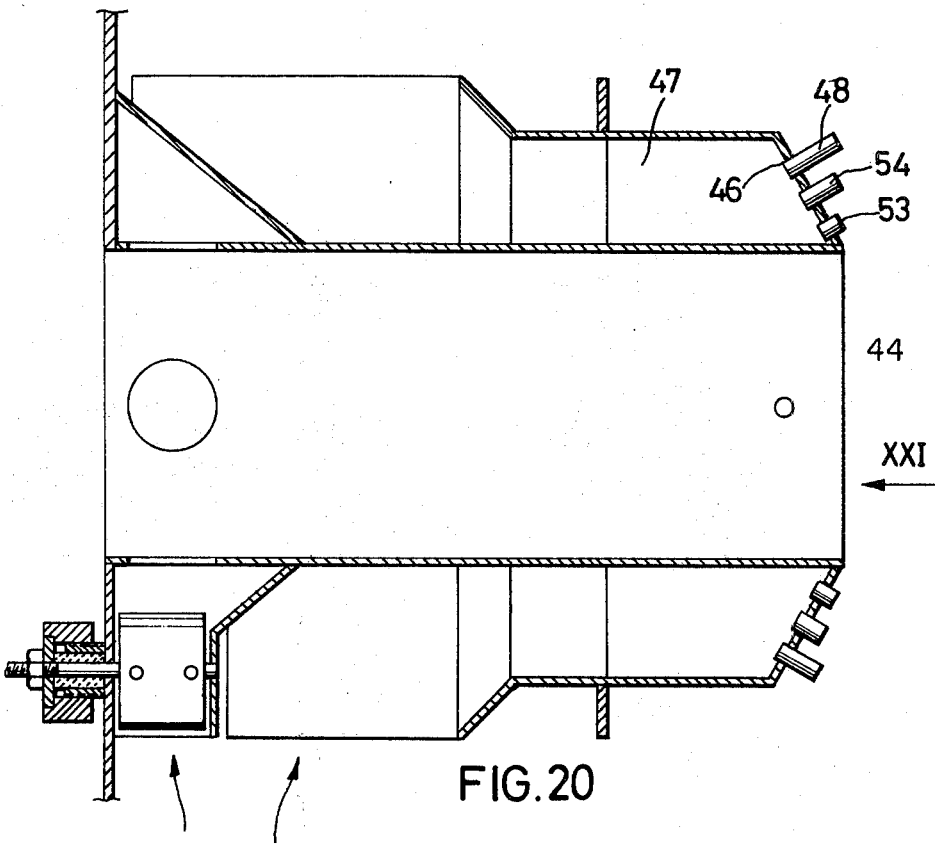
Figure 21:
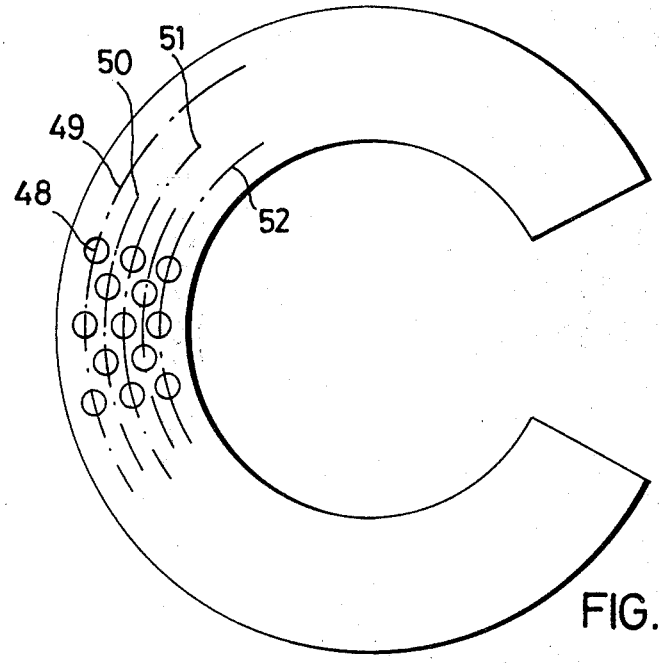
Figure 22:
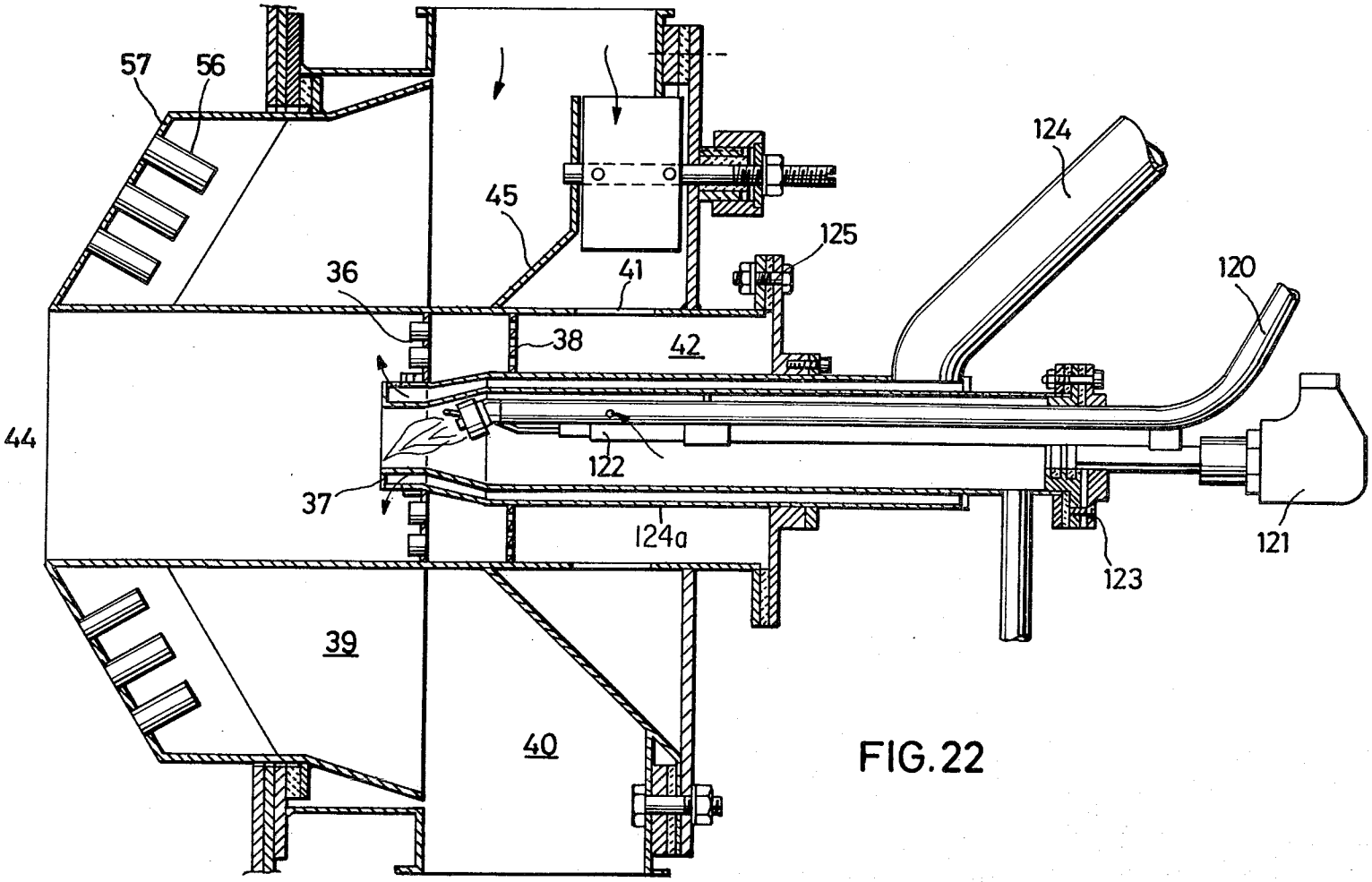
FIG. 22 another modified design of a burner arrangement according to the invention in a schematic representation of details, FIGS. 23, 24, 25, 26 details of further variants of the object according to the invention in elevation sectioned and in schematic representation, FIG. 27 a detail of another variant of the object according to the invention, designed as a so-called "plane burner" in a perspective, schematic, representation, FIG. 28 the arrangement according to FIG. 27 in a front view, partly in sectional and enlarged, FIG. 29 a further modified embodiment of the object according to the invention, again in elevation and in schematic representation, FIGS. 30, 31, 32, 33 details of further variants of the object of the invention, each in elevation in section and in schematic representation.
Figure 23:
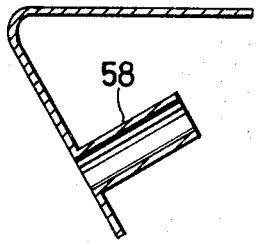
Figure 24:
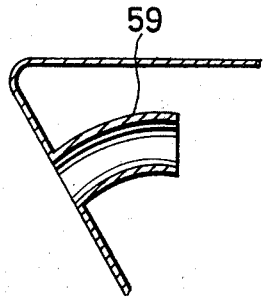
Figure 25:
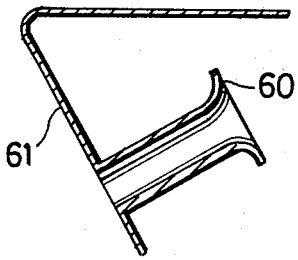
Figure 26:
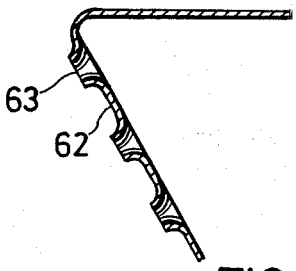
Figure 27:
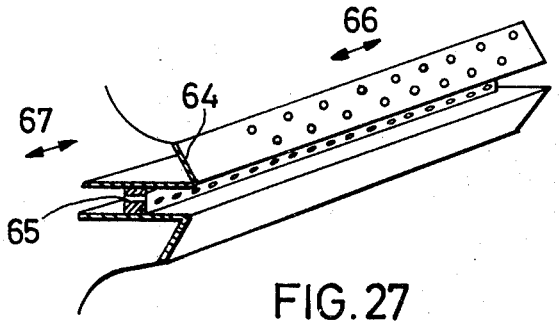
Figure 28:
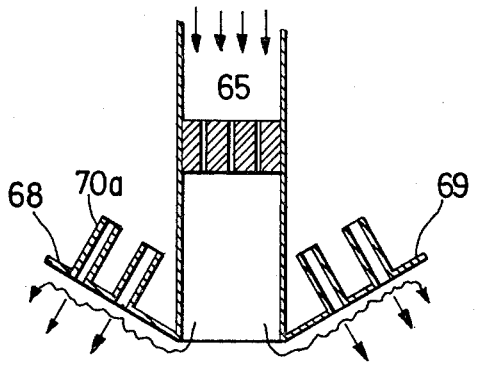

Whereas in the case of FIG. 4 the supply pipe for the fuel consists of an oil-feeder pipe 17 at the mouth of which the spray nozzle 29 is mounted, and which is associated with a twisting device 24 lying beyond it when viewed in the direction of flow — it can for example be fitted to the oil supply pipe — the supply pipe provided with the system according to FIG. 6, which is gas operated, is an annular cylinder 31*a*, with a deflector 32 in front of the cylinder mouth — when seen in the flow direction, this deflector is axially behind the cylinder mouth — which deflects the air stream leaving the annular tube 31*a* radially towards the outside as indicated by arrow 33. In this case, the annular space 34 containing the primary air is closed by means of a perforated disc 35 which, seen in the axial direction, lies in front of the deflector plate. The perforated disc enables the gas to be mixed with the primary air even more efficiently, not only creating a good distribution in the stream in the zone of the primary air but also creating a very intense turbulence which, in turn, promotes and improves the mixing of gas with primary air, so that the result is a correct preliminary mixture. The deflector plate can, if desired, be axially adjustable, so that the quantity can be controlled. Viewed in the axial direction, at least one twisting device 36, preferably, however, several of these devices could be provided behind the perforated disc, using for example two twisting devices with opposite action which are coaxial in relation to one another and which are located in front of the mouth of the gas supply pipe, when viewed in the axial direction. Twisting devices of this type 36 are shown, for example, in FIG. 22 where 37 denotes the gas supply pipe, 38 is the perforated disc, 39 the annular reservoir, and 40 the waste air spiral. This embodiment according to FIG. 22 shows that the passage holes 41 through which the primary air is admitted into the annular space 42, are located on the side away from the combustion chamber 44, approximately in the zone of the axial end of the burner tube, the waste air being introduced from the inlet head into the annular reservoir through a funnel-shaped section 45 which extends at an angle towards the burner tube and towards the reservoir 39. By this method it is ensured that the control of the waste air is particularly good and favourable from the viewpoint of fluid dynamics. The individual tubes consist preferably of a heat resisting material; the diameter of the individual tubes is preferably to the diameter of the burner tube in a ratio of 1 : 10 to 1 : 25. As indicted in the various illustrations, the individual tubes consist of tube sections which extend in a direction inclined towards the longitudinal median axis of the burner tube. In the case of the embodiment according to FIG. 20, the tube sections are used at an angle between 15° and 40°, preferably 30°, in corresponding apertures 46 in the end-wall 57 of the reservoir 47, the sections being firmly connected with this end-wall by welding. They extend towards the combustion chamber 48 and are level, at least approximately, at their other end, with the end-wall. This FIG. 20, and also FIG. 21 shows that the individual tubes 48 are arranged to several, for example three or four, concentric circles 49, 50, 51, 52 which are spaced equidistantly, the tubes of one circle, compared with those of the other circle, being staggered by the same amount when regarded in the direction of the circumference and whereby furthermore the tube sections on the same circle having the same length, the length of the tube sections on the individual circles increasing from the innermost circle towards the outside, preferably by the same amount. FIG. 20 shows that tube sections 53 are shorter than tube sections 54 and that these, in turn, are shorter than the tube sections 48. Alternatively the tube sections could project towards the interior of the cylindrical reservoir, as indicated in FIG. 22, where the tube secitons 56 project into the reservoir 39, and are at least approximately level, at their other ends, with the front wall 57. Tube sections which project into the interior are shown, for example, in FIG. 23, at 58. Here, an excessive speed is created; here the longitudinal median axis of the individual tubes is a straight line. However, these individual tubes can also have a curved longitudinal median axis 59 as indicated in FIG. 24, and in this case the air stream is restricted, followed by excessive speed, or the intake section of the individual tubes can be shaped as shown in FIG. 25, at 60. Alternatively, the inclination of the end wall 61 of the reservoir could be less acute. The individual tubes could alternatively be an integral part of the end wall 62, as indicated in 63 of FIG. 26. According to FIG. 27 the burner can be designed as a plane burner, where the various parts serving for the control of the waste air (portion 64) and of the fuel supply (portion 65) extend over a greater area according to arrows 66 across the axial length according to arrow 67, the conventional cylindrical or tubular form being replaced by a prismatic shape. FIG. 27 depicts such an arrangement in a perspective, schematic representation. FIG. 28 shows the arrangement in a front view, partly in section and again in a schematic representation. The front walls of the reservoir are here denoted by 68 and 69; 70 are the individual tubes which discharge the waste air. Apart from this, the arrangement corresponds largely to the variants described above. With the embodiments described so far, the end wall which accommodates the individual tubes is inclined, but it can also be at right angles or approximately at right angles with the longitudinal median axis of the system.

Figure 29:
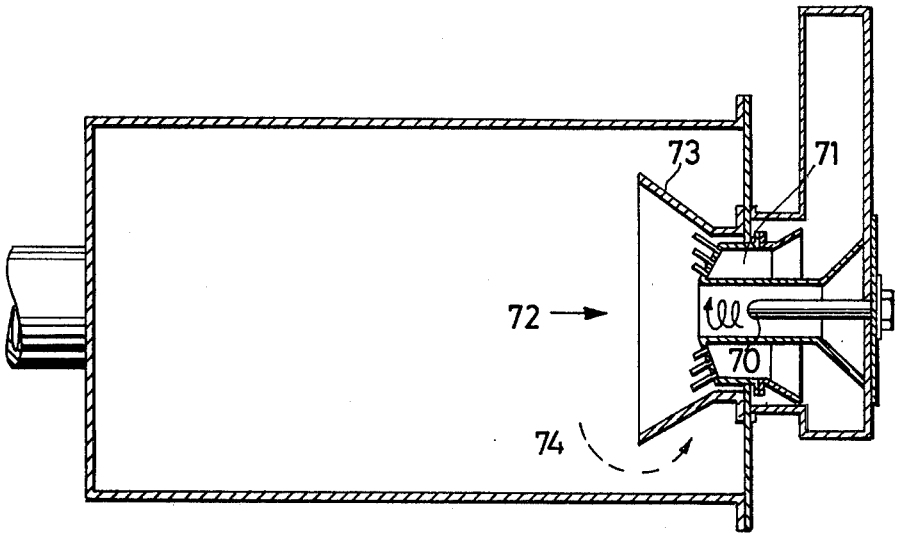

With all embodiments described above the twisting-apparatus and devices consist preferably of blade-type objects which are distributed around the longitudinal median axis of the burner tube, the blades being inclined towards the radius and preferably spaced equidistantly. According to FIG. 29 the mouth of the burner tube 70 and that of the reservoir 71 are surrounded by a control-funnel 73 which opens out in the direciton of the combustion chamber 72, its purpose being to prevent returning air streams from interfering with the process of combustion when their flow is directed, say, in accordance with the broken-line arrows 74. It is moreover indicated that the varioius twisting-apparatus and devices are axially adjustable.

The burner-head is preferably surrounded by a burner stone 75 (see FIG. 4) which widens in funnel-fashion towards the combustion chamber, seen in the axial direction. The stone consists of a heat-resisting material and is mounted on the wall of the combustion chamber. It serves on the one hand as an additional means by which to control the form of the flame and it re-radiates, on the other hand, heat to the centre.

As for the rest, provision has been made for the individual parts of the system to be disassembled without difficulty. For example, the burner asembly is such that the part of the primary air can be taken out without removing, or adjusting, the twisting apparatus. Similarly, the twisting apparatus or devices can be taken out of the unit without having to interfere with the waste-air spiral; or the ignition electrodes, the flame monitor etc. can be taken out of the middle section. Accoding to FIG. 22, the ignition-burner 120, the photoelectric cell of flame-monitor respectively 121, and the ignition electrodes 122 constitute together the inner unit which can be removed from the system after loosening the flange connection 123. The outer unit, which is fully independent of the former and which consists of the gas supply 124 and tube 124*a*, can be removed after loosening the flanged connection 125.

Figure 8:
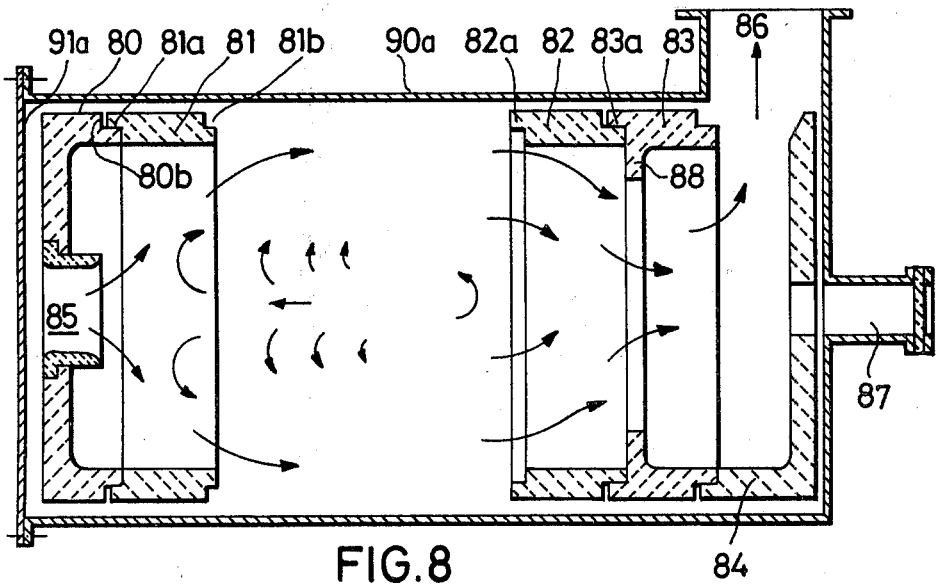
FIG. 8 a combustion chamber for the system according to the invention, in an elevation in section, but schematically represented, FIG. 9 and FIG. 10 a valve provided for a bypass-system in a post-combustion plant, in front-view and in sectional elevation, enlarged, FIG. 11 schematic elevation of a heat exchanger used in connection with a burner system according to the invention, FIG. 12 a first practical example for the burner system according to the invention used in a thermal post-combustion plant, in elevation, partly in section, in a schematic representation, FIGS. 13 and 14 two variants for the regulation of the oil supply to a burner unit according to the invention, in schematic representation, FIG. 15 a variant to the arrangement according to FIG. 12 using the same manner of representation, FIG. 16 again a variant to the arrangement according to FIGS. 12 and 15 in elevation, partly sectional, FIG. 17 the arrangement according to FIG. 16 in a section corresponding to Line XVII—XVII of FIG. 16.
Figure 18:
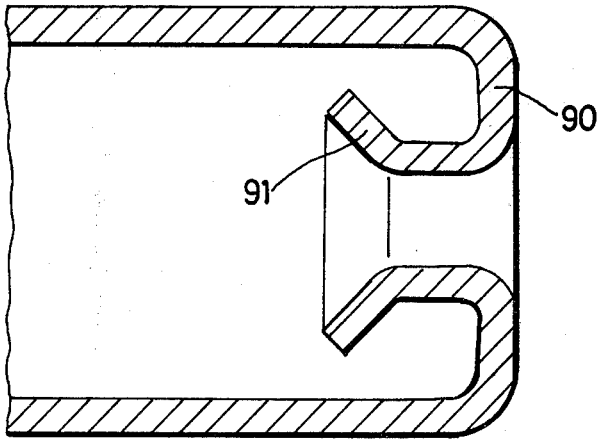
FIG. 18 a detail of a combustion chamber for a burner system according to the invention, schematically shown in elevation and in section, FIG. 19 another variant according to FIGS. 12 and 15, in elevation, in section and schematic representation, FIG. 20 a modified embodiment, showing a burner system schematically in elevation, FIG. 21 the arrangement according to FIG. 20 viewed in accordance with Arrow XXI of FIG. 20.
Figure 19:
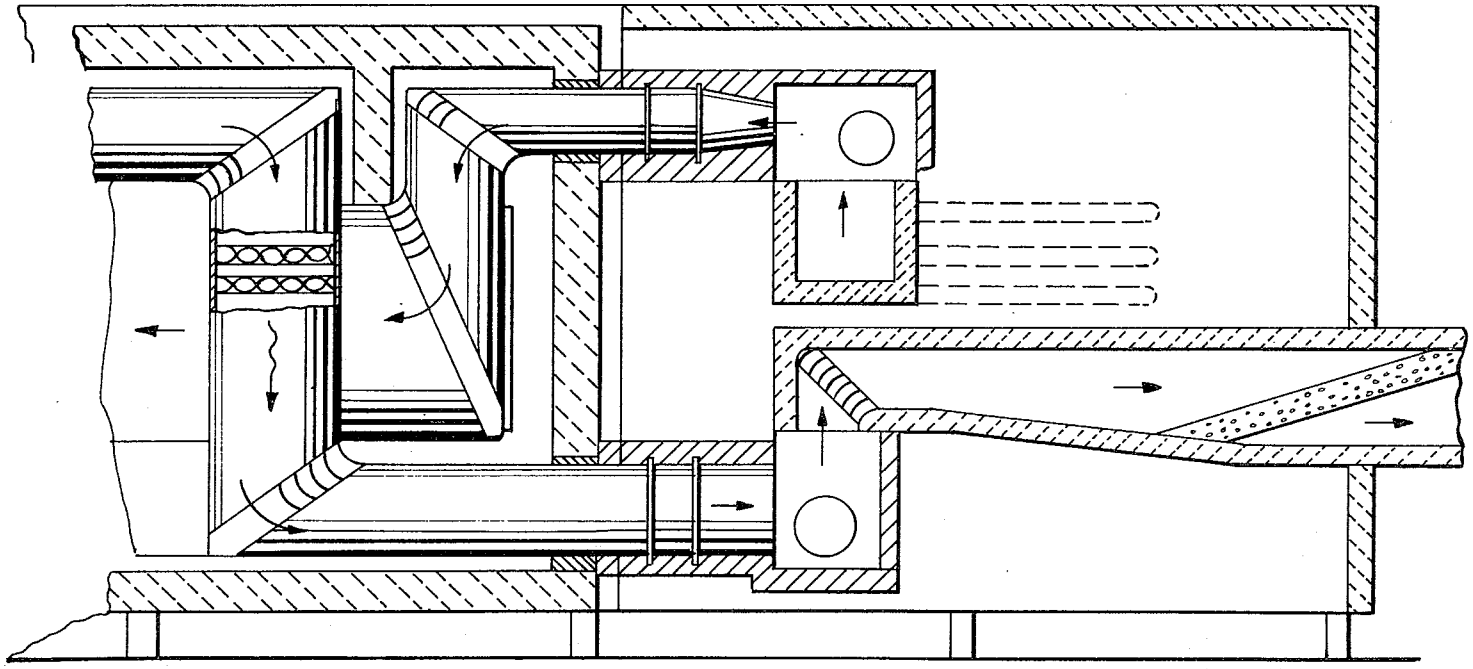

According to FIG. 8 the combustion chamber can be assembled of several rings 80, 81, 82, 83 84, etc. which are axially arranged one behind the other and can consist, for example, of ceramic castings. The last ring, seen in the direction from the burner 85, comprises an exhaust port 86 for the burnt up gases and incorporates preferably a window 87 through which to observe the interior of the combustion chamber, while the last stone but one comprises an annular zone 88 which projects radially towards the inside in the manner of a stop, preventing air jets which enter at 85 from passing towards the exhaust port 86 in an approximately straight line and contributing towards the formation of a spherical or fan-shaped explosion flame. According to FIG. 18, also, the form of the combustion chamber which suddenly widens at 90 at the burner mouth contributes towards the forming of the flame. In this case, guide walls 91 can be provided which, diverging towards the outside, assist the explosion of the flame. The rings 80, 81, 82, 83, according to FIG. 8 can be joined for example in a tongue and groove connection, axially projecting portions 81*a*, 82*a*, 83*a* engaging with corresponding recesses 80*b*, 81*b* etc. in the adjacent ring. FIG. 8 moreover shows that the rings 80, 81, 82, etc. are accommodated in a roughly cylindrical chamber 90*a* which can consist of metal and have a front wall 91*a* opposite the combustion chamber which can be taken off, for example by unscrewing, to give access to the rings, for example when one of them is damaged.

Figure 9:
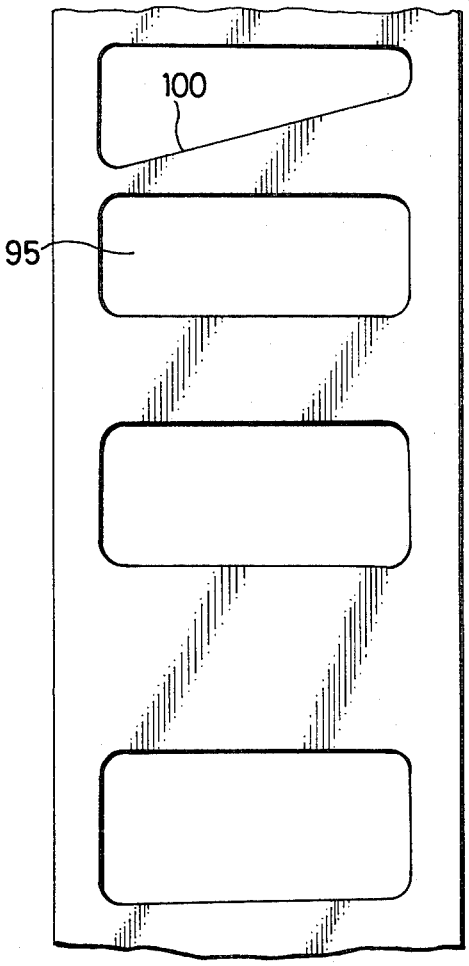
Figure 10:
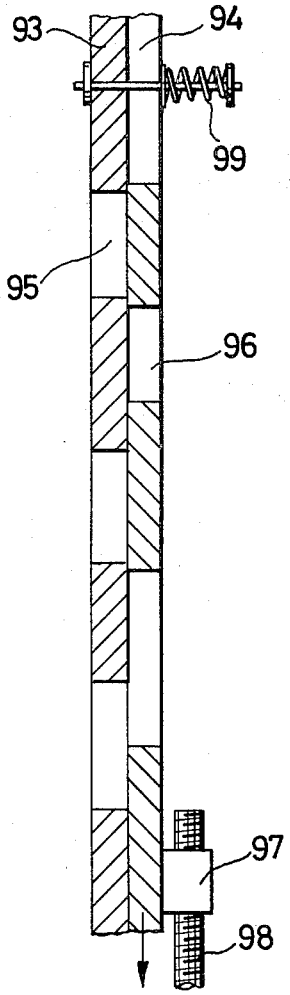

As explained in previous patent specifications of the same applicants, thermal post-combustion plants of the type described above often provide the means by which the waste air stream discharged from the industrial plant is introduced into the combustion chamber in a more or less direct manner, bypassing the heat-exchanger for the primary heating process either partly or completely. These measures have been taken with a view to controlling the quantity of heat in the circulating air, or rather its temperature. The quantity of waste air which is admitted is thereby controlled by the aid of a slide. In order to make this control as sensitive as possible, the invention moreover comprises, as shown in FIGS. 9 and 10, a slide which consists of two slide-plates 93, 94, which rest against each other and are adjustable in relation to each other, and incorporate passage holes 95, 96 which are staggered in relation to each other when the slide assumes its starting position. One of the plates, for example 93, is fixed while the other plate, for example 94, can be adjusted in relation to the former in the longitudinal direction of the plates, the adjustable plate 94 being provided with a nut 97 accommodating a stationary threaded spindle 98 which is driven for example by means of a reversible, and preferably temperature-controlled, motor. The two slide-plates are under the load of a spring 99 which ensures that they rest against each other. As indicated in particular in FIG. 9, the passage holes are longitudinal slots which can be designed in such a manner that the slots in either plate are dimensioned and/or staggered in relation to each other and/or provided with, for example, inclined edges or borders which extend at a given angle so that the paassage can be gradually regulated, the opening being steadily increased. The relative movements between the two plates could, for example, be such that first only one of the slots is gradually opened, the other slots being subsequently opened one by one. As indicated in FIG. 9 at 100, the edges can for example extend at an angle so that first one corner of the slot is opened, the total free area being subsequently made available. This method enables the regulation to be very precise, and it is possible in spite of considerable pressure differences which may be encountered, to obtain a linear characteristic between the opened area and the path.

Figure 11:
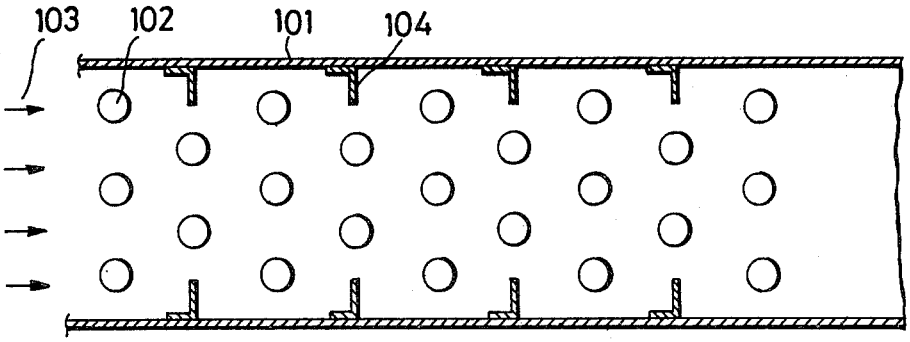

In a system comprising a heat-exchanger unit for the pre-heating of the waste air which consists of a heat-exchanger casing 101 according to FIG. 11 which accommodates a number of tubes 102 conducting the waste gases away from the combustion chamber, and where the waste air stream is passed over the tubes as indicated by arrows 103 before entering the combustion chamber, the casing of the device can be narrow and long when viewed in the direction of flow, provision being made for a small number of tubes in a tiered arrangement while the total number of tubes lying one behind the other is great. This arrangement is particularly favourable for the problems of the present invention. The inner wall surfaces support resistance elements 104 which can, for example, consist of corner pieces fixed to the inner casing wall, their purpose being to counteract the possible formation of split air-streams along the inner surface of the wall. These split air streams may perhaps be considered unimportant in a wide heat exchanger, they are, however, significant in narrow heat exchangers of the type here used with preference.

When oil is used as fuel, it can be supplied through two jet nozzles 105, 106, the fuel being delivered from a pump 107 which is preferably provided with a return pipe 103, the nozzles being fed with oil through associated special magnet valves 109, 110 which connect and disconnect the nozzles in dependence on the air temperature. For exmaple, when nozzle 105 is primarily in action nozzle 106 can be connected into the oil supply system when the energy demand is high, and it can be disconnected again, by the magnet valve 110 when the energy demand declines. Alternatively, these requirements can also be met by a so-called return nozzle 111, both the forward pipe 12 and the return pipe 113 being controlled through individual magnet valves 114 and 115 respectively which operate in dependency of the air temperature, a pump 117 which is provided with a return pipe 116, feeding the nozzle. Regulation is based on a similar principle.

Figure 12:
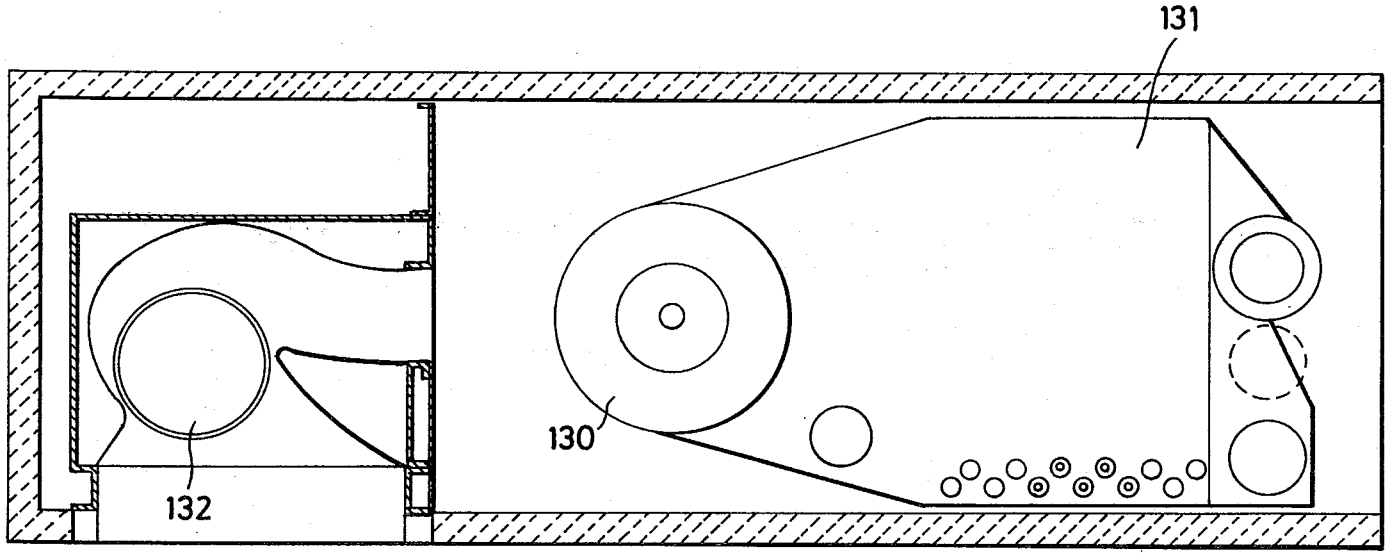
Figure 13:
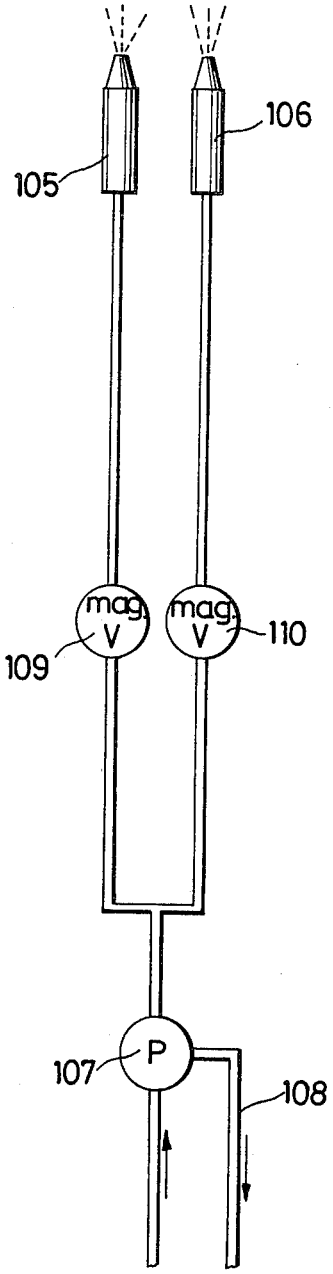
Figure 14:
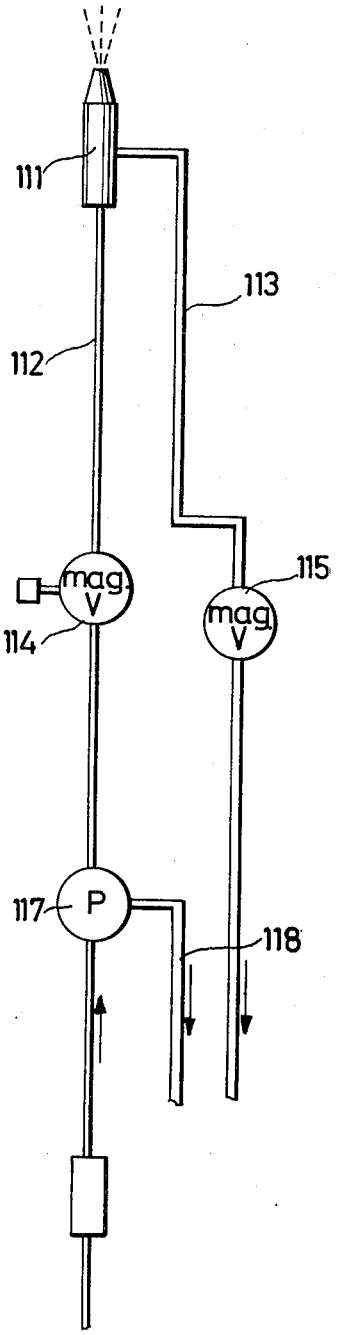
Figure 15:
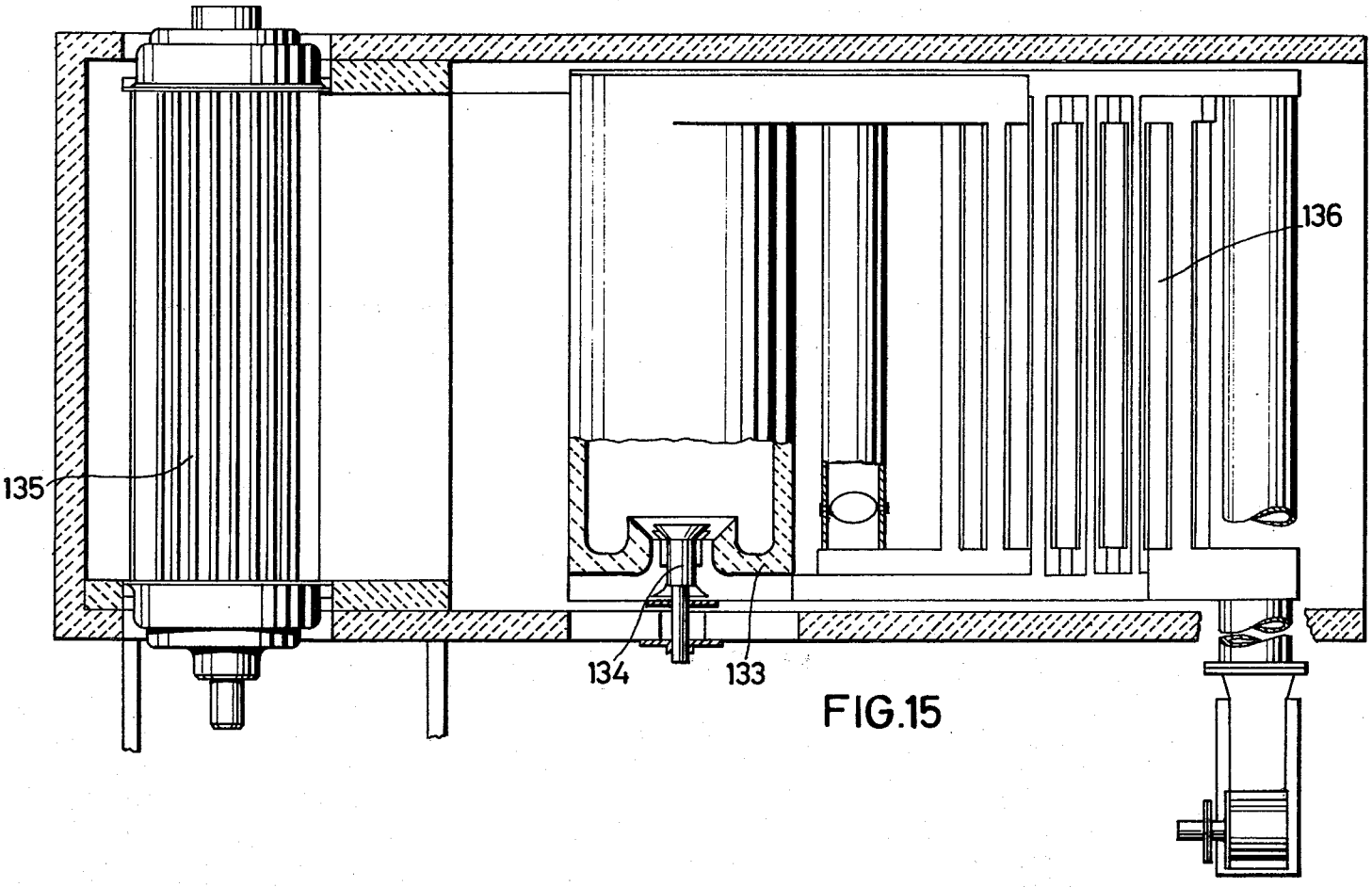
Figure 16:
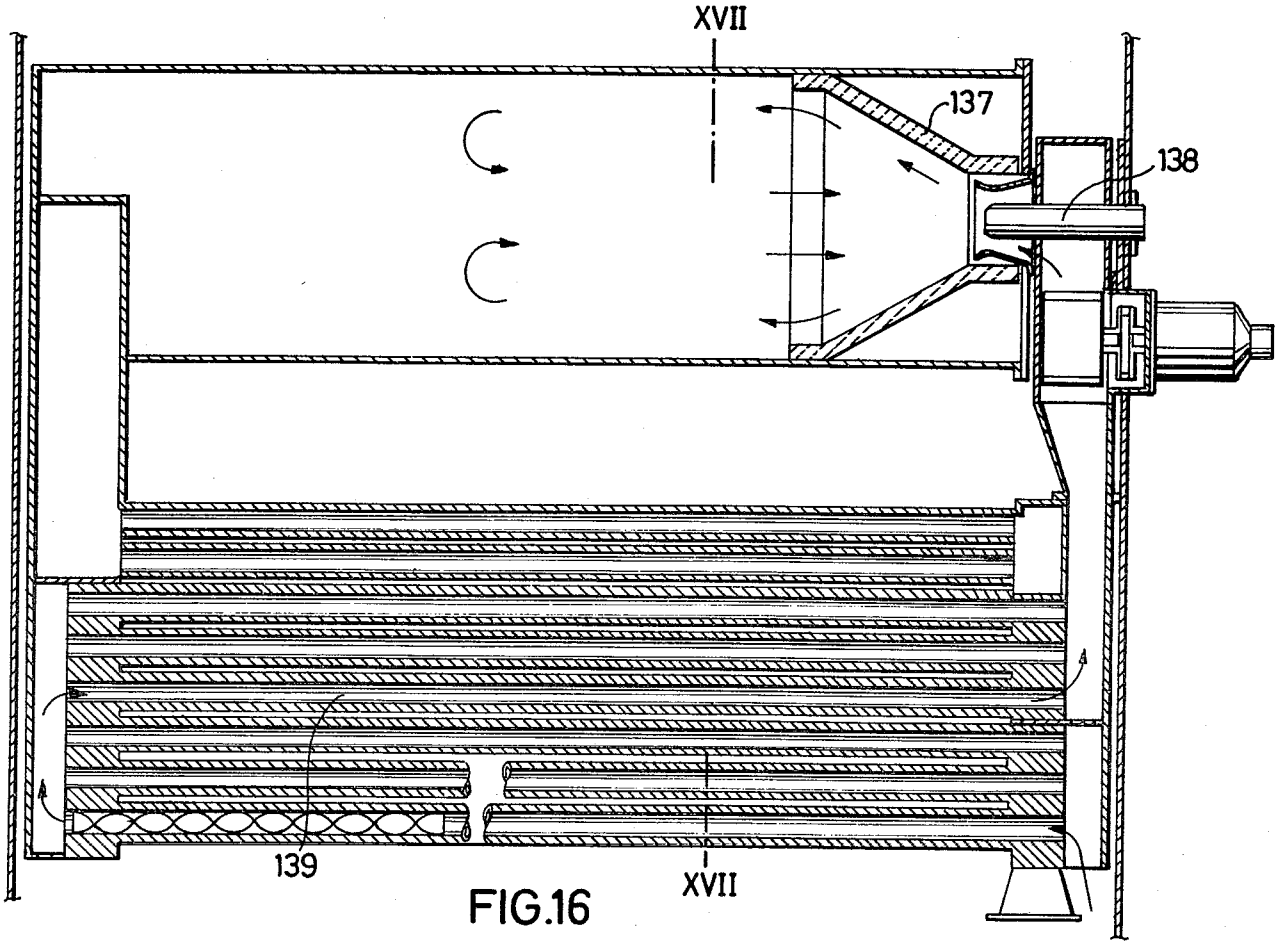
Figure 17:
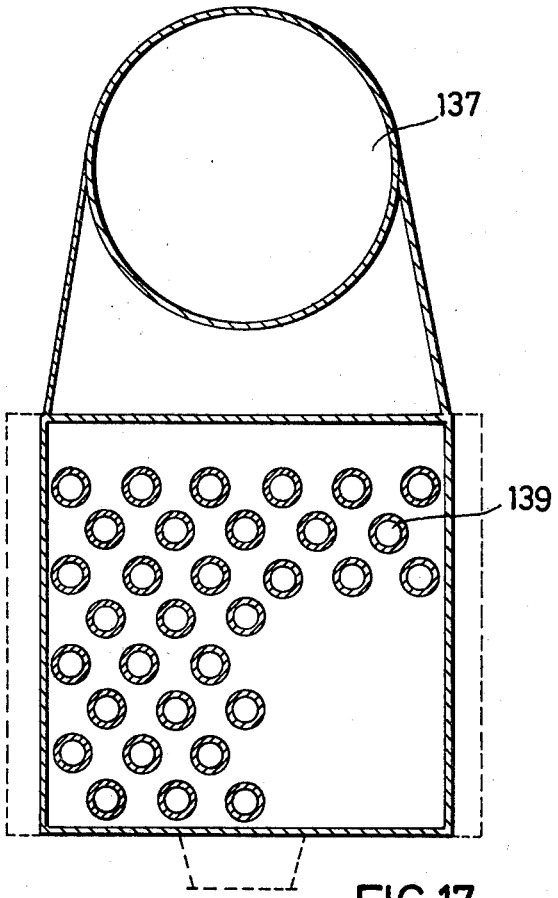

FIGS. 12, 15, 16, 17 and 19 show various applicabilities or rather designs for thermal post-combustion plants, which comprise the burner arrangement according to the invention. FIG. 12 shows the combustion chamber 130 with heat-exchanger system 131 and delivery-blower 132. In the design according to FIG. 13, the combustion chamber 133 is shown with a burner 134, blower 135, and heat-exchanger unit 136. In FIGS. 16 and 17, the combustion chamber 137 is shown with burner 138 and heat-exchanger system 139.

Figure 30:
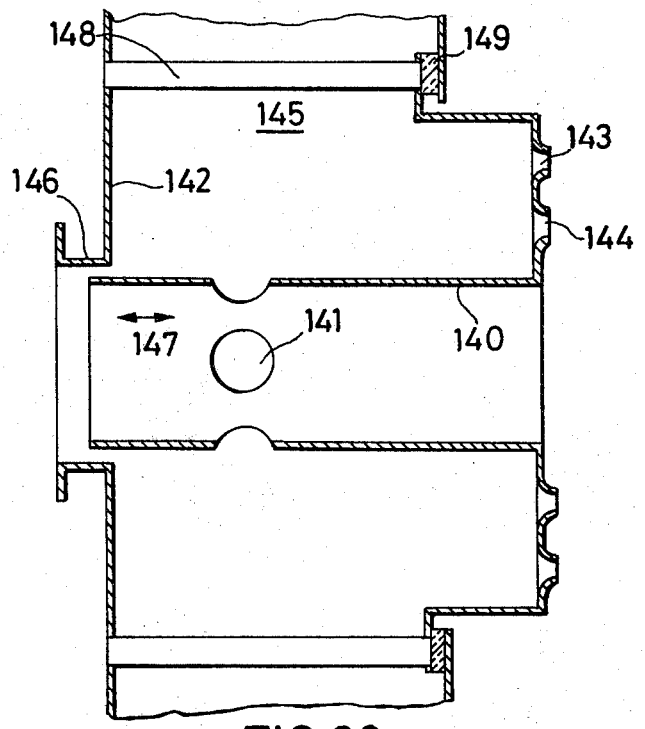
Figure 31:
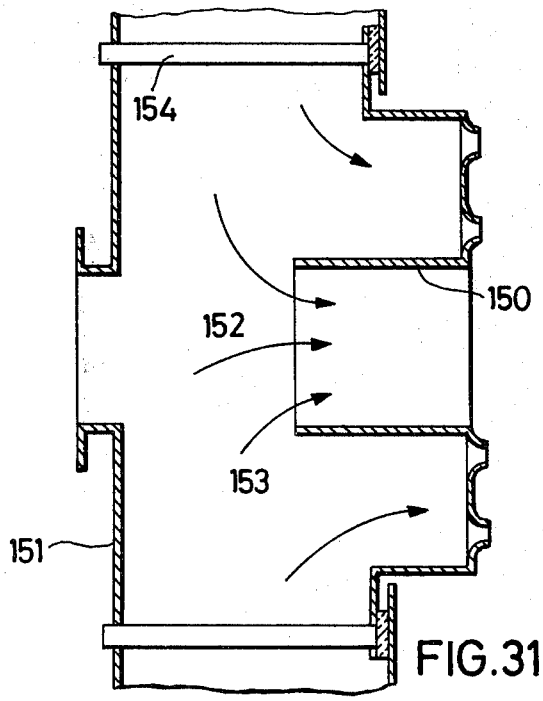
Figure 32:
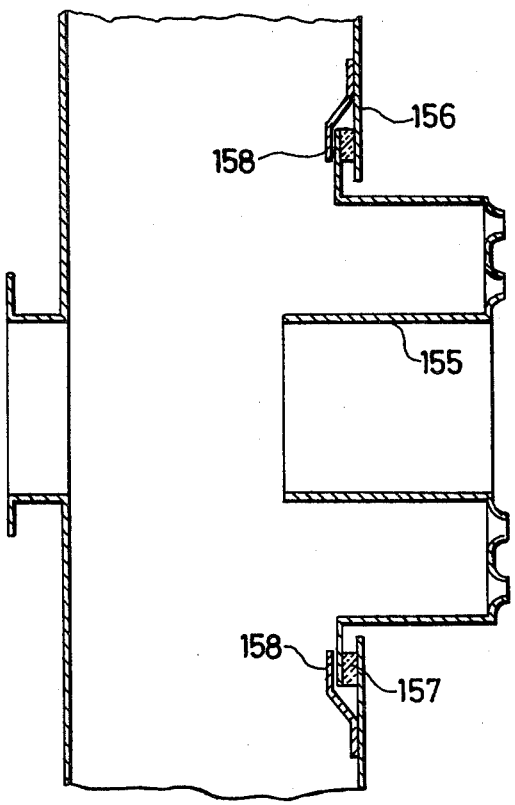
Figure 33:
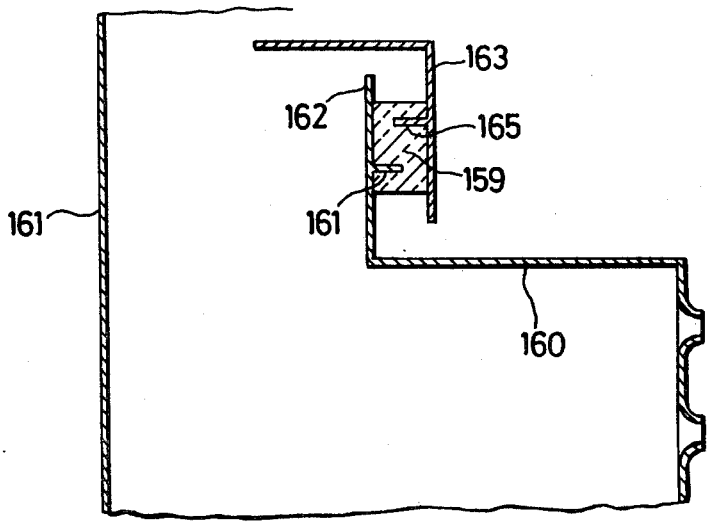

In the design depicted in FIG. 30, the burner tube 140 with passage holes 141 for the passage of the primary air is not firmly connected, for example by welding, with the wall portions 142 which are oposite to the front wall 143 with the individual tubes 144 and which moreover constitute part of the reservoir 145, but it is flexibly supported at 146 in such a manner that a relative movement is possible in the direction of arrow 147. A connecting tie 148 and packing 149 provide the joint between the wall portions 142, which in a way are part of the casing, and the burner tube. The particularly hot parts of the system are thereby prevented from making direct contact through solid connections with the other portions of the wall, and a certain degree of flexibility is given. FIG. 31 shows a similar design. Here the burner tube 150 does not extend to the wall portion 151 of the reservoir, and consequently a free space 152 is available which is especially useful for the admission of the primary air as indicated by arrows 153. However, insertion is, in this case, slightly more difficult. The arrangement shown in FIG. 32 is similar to that according to FIG. 31 but differs from the latter in that the ties 154 are disconnectable, since they are fitted by the aid of clips 158 and packings 157 to the wall portions 156 (casing wall). The advantage of this arrangement is that components which are subjected to wear, which are essentially parts of the burner tube 155, can be replaced very simply, and any necessary repair work is thus considerably facilitated. Finally, the design according to FIG. 33 provides for improved sealing conditions. The packing 159 between the burner tube 160 and wall portions 161 of the casing wall which, unlike previous designs, is no longer compressed between two plane surfaces but incorporates two flanges 162, 163 with webs 164 and possibly 165, which extend at right angles for example, about parallel with the longitudinal median axis, and are pressed into the packing when the flanges are pressed against each other, thereby improving the sealing effect of the packing.

What I claim is:

1. A method for the operation of a burner system for the thermal post-combustion of waste air from industrial plants, which system comprises a combustion chamber, a burner system proper which opens into the combustion chamber and which includes a burner and a burner pipe for supplying the burner, and supply pipes for the waste air for post-combustion, through which pipes the waste air is conducted into the zone of the burner mouth inside the combustion chamber, which comprises producing a primary flame which explodes into a fan at the point where the burner opens into the combustion chamber, introducing the waste air into the combustion chamber approximately concentrically with and around the primary flame, and twisting the primary flame as it enters the combustion chamber around the longitudinal median axis of the burner pipe.

2. In a method according to claim 1, delivering the waste air in the form of two annular jets which surround each other and the primary flame in a coaxial arrangement, and twisting the annular jets and the primary flame around the longitudinal median axis of the burner tube as they enter the combustion chamber, the twist given to the inner annular jet being opposite to the direction in which the primary flame and the other annular jet are twisted.

3. In a method according to claim 1, decomposing the jet of waste air which surrounds the primary flame into a large number of individual jet-rays.

4. A burner system for the thermal post-combustion of waste air from industrial plants, which comprises a combustion chamber, a burner system proper which opens into the combustion chamber, and supply pipes for the waaste air for post-combustion, through which pipes the waste air is conducted into the zone of the burner mouth inside the combustion chamber, which comprises means to produce a primary flame which explodes into a fan at the point where the burner opens into the combustion chamber, means for introducing the waste air into the combustion chamber approximately concentrically with and around the primary flame, and means for decomposing the jet of waste air which surrounds the primary flame into a large number of individual jet rays, having a burner tube for supplying the burner, a fuel supply pipe passing through the burner means, in which the means for introducing the waste air into the combustion chamber comprises annular tube means into which the waste air is delivered surrounding the burner tube, the means for producing a primary flame includes a waste-air spiral in the path of the waste air flowing through the annular tube means, and the means for decomposing the jet of waste air comprises waste oulets leading from the annular tube means toward the combustion chamber and at least one twisting apparatus adjacent the downstream end of the annular tube means by the air of which the waste air stream is twisted around the longitudinal median axis of the burner tube, and a twisting device located adjacent the downstream end of the burner tube by the aid of which the primary flame is twisted around the longitudinal axis of the burner tube.

5. In a burner system according to claim 4, the annular tube means comprising concentric annular tubes for the waste air stream and the twisting appartus includes means which twist waste air flowing in said concentric tubes in opposite directions.

6. In a burner system according to claim 4 the annular tube means having a tube portion which widens in funnel-fashion towards the outside, the twisting apparatus being located in said tube portion.

7. A burner system according to claim 4, wherein the portions of the individual tubes which extend into the combustion chamber have an inclined direction pointing towards the outside.

8. A burner system according to claim 4, wherein the annular tube means and waste air outlets project in relation to the twisting device downstreamward by an amount which corresponds approximately to between twice or three-times the diameter of the burner tube.

9. A burner system according to claim 4, wherein openings are provided connecting the annular space between the fuel supply pipe and the burner tube with the interior of the annular tube means through which primary air is admitted into the burner tube and means are provided for adjusting the flow-cross-section of the holes.

10. A burner system according to claim 9, wherein the holes are distributed over the axial length of the burner tube.

11. A burner system according to claim 9, wherein the passage holes are located adjacent the end of the burner tube which is further from the combustion chamber.

12. In a burner system according to claim 4, in which the means connecting the interior of the reservoir with the combustion chamber comprises annular tube means downstream from the inlet head of the waste-air spiral and joined thereto, the ratio between the widths of the inlet head and the annular tube means being approximately 2:1.

13. In a burner system according to claim 12, a funnel-shaped guide piece conducting the waste air from the inlet head into the annular tube means, said funnel-shaped guide piece extending at an inclination in relation to the burner tube and to the reservoir.

14. A burner system according to claim 4, for operation by gas, wherein the fuel supply pipe comprises a ring-cylinder tube provided at its mouth with an axially adjustable deflector disc which lies downstream from the tube mouth and deflects the gas stream discharged from the ring-cylinder tube axially towards the outside.

15. A Burner system according to claim 14, wherein the annular space between the burner tube and the fuel supply pipe through which the primary air stream passes is provided at its front section with a perforated plate which is located upstream from the deflector disc.

16. A burner system according to claim 4, wherein a perforated plate is provided in the burner tube and at least one twisting appartus is provided in the burner tube downstream from the perforated plate.

17. A burner system according to claim 16, wherein the twisting device lies upstream from the mouth of the fuel supply tube.

18. A burner system according to claim 4, wherein the ratio between the diameter of the individual tubes and the burner tube is between 1:10 and 1:25.

19. A burner system according to claim 4, wherein the individual tubes comprise tube sections which are inclined towards the longitudinal median axis of the burner tube at an angle between 150° and 40°, the tube sections being inserted into corresponding apertures in the front wall of the ring-cylindrical reservoir, and fixed to it by welding.

20. A burner system according to claim 19, wherein the tube sections towards the combustion chamber, their other ends being at least approximately in line with the front wall of the reservoir.

21. A burner system according to claim 19, wherein the tube sections into the interior of the reservoir and align at their other side at least approximately with the front wall thereof.

22. A burner system according to claim 4, wherein the individual tubes form an integral part with the front wall of the reservoir.

23. A burner system acording to claim 4, wherein the individual tubes are arranged in at least three concentric circles which are uniformly equidistant one from the others, the tubes on one of the circles, seen in the circumferential direction, being staggered in relation to those of the other circle by the same amount and the tube sections in each of the circles having identical lengths, the length of the tube in the innermost circle being shortest and the tube lengths increasing towards the outside.

24. A burner system according to claim 4, in which the individual tubes have a straight-line longitudinal axis.

25. A burner system according to claim 4, in which the individual tubes have a longitudinal axis curved arch-like.

26. A burner system according to claim 4, wherein the intake section of the individual tubes is funnel-shaped.

27. A burner system according to claim 4; wherein the wall which separates the reservoir from the combustion chamber and and incorporates the individual tubes is inclined to the longitudinal median axis of the tube at an angle between 15° and 40°.

28. A burner system according to claim 4, wherein the wall which separates the reservoir from the combustion chamber and contains the individual tubes is approximately at right angles to the longitudinal center line of the tube.

29. A burner system according to claim 4 designed as a plane-burner wherein the components serving for the conveyance of waste air and fuel extend over a relatively long distance across the axial length and have a prismatic shape.

30. A burner system according to claim 4, wherein the twisting apparatus and device comprise blade-shaped objects which are arranged at an angle with the radius around the longitudinal median axis of the burner tube.

31. A burner system according to claim 4, wherein the twisting apparatus and device are axially adjustable.

32. A burner system according to claim 4, having around the burner head a burner-stone which widens in the axial direction towards the combustion chamber into a funnel-shaped object and is formed a heat resistant material.

33. A burner system according to claim 32 wherein the burner-stone is mounted on the wall of the combustion chamber.

34. A burner system according to claim 4, having a control funnel surrounding the mouths of the burner tube and of the reservoir, which control funnel widens towards the combustion chamber.

35. A burner system according to claim 4, wherein a flame monitor means forms an inner unit together with ignition-electrodes, an outer unit being formed by the fuel supply pipes and the burner tube, and wherein the two units can be taken out independently of each other and individually after loosening corresponding flange connections.

36. A burner system according to claim 4, wherein the combustion chamber comprises a plurality of axially consecutive rings of a ceramics material, the last ring of the assembled unit, seen from the side of the burner, comprising a sighting window through which the interior of the combustion chamber can be inspected, and a discharge port for burnt-up waste gases, while the penultimate stone comprises an annular portion which projects towards the inside and acts as a stopping-blend.

37. A burner system according to claim 36 wherein the rings engage with one another on the principle of a tongue and groove assembly, axially projecting portions of one ring fitting into corresponding recesses in the adjacent ring.

38. A burner system according to claim 36, having a cylindrical chamber of metal and having a front wall at the burner side which is detachable.

39. A burner system according to claim 36, wherein the cross-section of the combustion chamber is suddenly increased at the point where the burner enters the chamber, and guidewalls are provided in the zone of the burner mouth which, diverging towards the outside, assist the explosion of the flame.

40. A burner system according to claim 4, comprising a by-pass unit by the aid of which waste air, delivered from the industrial plant, is at least partly directly conducted into the combustion chamber, a heat exchanger for preheating and means for by-passig the heating chamber, means to control the quantity of waste air which is admitted into the combustion chamber comprising a slider formed of two slider-plates which rest against each other and are movable in relation to each other, and contain holes which are staggered in relation to each other when the slider is in its initial position.

41. A burner system according to claim 40 wherein one of the slider plates is in a fixed position while the other is longitudinally adjustable on the first plate be a nut accommodating a stationary rotating threaded spindle driven by a reversible motor which is temperature dependent.

42. A burner system according to claim 40, wherein a spring pressed the two slider plates against each other.

43. A burner system according to claim 40, wherein the holes in the two slider plates are designed so that the flow cross-section can be gradually increased at a constant rate.

44. A burner system according to claim 4 comprising a heat-exchanger unit for the pre-heating of the waste air, which contains a number of tubes conducting the waste gases discharged from the combustion chamber, in a heat-exchanger casing, the waste air stream being sprayed over the tubes prior to entering the combustion chamber, the casing having a narrow and elongated form seen in the direction of flow, and resistance-elements on the inner wall surfaces of the casing to counteract the formation of split streams along the inner surface of the casing wall.

45. Burner system according to claim 4, in an oil operated system, in which the fuel supply means includes two jets for which are fed individually with fuel by a pump provided with a return lead, each jet being supplied through coordinated magnet valves which connect, or disconnect, the jets in dependence on the air temperature.

46. A burner system according to claim 4, wherein — in oil operated systems — a return jet is provided for the fuel supply, and both the supply pipe and the return pipe are controlled by an individual magnetic valve which operates in dependence on the air temperature, and which are controlled from a pump preferably provided with a return system.

47. A burner system according to claim 4, wherein the end of the burner tube which is opposite to the end at the combustion chamber is fixed to the adjacent portions of the casing-wall.

48. A burner system according to claim 4, wherein the end of the burner tube which is oposite to the end at the combustion chamber is flexibly supported at the adjacent portions of the casing wall, the zone of the burner tube at the end facing the combustion chamber is connected by means of ties with the parts of the casing wall which face the other end of the tube, the tube being supported against the parts of the casing which face the combustion chamber and the end of the burner tube facing the combustion chamber comprises a plane butting surface on a flange-like portion which accommodates an annular packing between itself and a corresponding surface on the casing wall which faces the combustion chamber.

49. A burner system according to claim 48, wherein the butting surface of the burner tube comprises at least one web-like projection which extends in the direction of the longitudinal center line and is pressed into the packing when the butting surface and its counter-surface are pressed together.

50. A burner system as claimed in claim 4, which includes a burner tube for supplying the burner, a fuel supply pipe passing through the burner tube, and a reservoir surrounding the burner tube, in which the means to produce a primary flame includes a waste-air spiral for delivering into the reservoir and means connecting the interior of the reservoir with the combustion chamber, and the means for decomposing the jet of waste air comprises a plurality of individual small diameter tubes which project from the front end of the reservoir into the combustion chamber.

* * * * *